US009147926B2

(12) United States Patent
Tichauer et al.

(10) Patent No.: US 9,147,926 B2
(45) Date of Patent: Sep. 29, 2015

(54) DEVICE, APPARATUS AND METHOD FOR PRODUCING A BODY OR PLATFORM INTERFACED WITH A WIDEBAND ANTENNA SYSTEM

(71) Applicant: United Analytics Corporation, Truckee, CA (US)

(72) Inventors: Larry Martin Tichauer, La Palma, CA (US); Jeffrey Bernard Tichauer, Buena Park, CA (US)

(73) Assignee: United Analytics Corporation, Truckee, CA (US)

( * ) Notice: Subject to any disclaimer, the term of this patent is extended or adjusted under 35 U.S.C. 154(b) by 403 days.

(21) Appl. No.: 13/674,975

(22) Filed: Nov. 13, 2012

(65) Prior Publication Data

US 2014/0132472 A1 May 15, 2014

(51) Int. Cl.
*H01Q 1/24* (2006.01)
*H01P 11/00* (2006.01)

(52) U.S. Cl.
CPC ..... *H01P 11/00* (2013.01); *H01Q 1/243* (2013.01); *Y10T 29/49018* (2015.01)

(58) Field of Classification Search
CPC ..... H01Q 1/24; H01Q 1/273
USPC ..... 343/702, 718
See application file for complete search history.

(56) References Cited

U.S. PATENT DOCUMENTS

| | | | | |
|---|---|---|---|---|
| 2004/0056811 | A1* | 3/2004 | Pakray et al. | 343/713 |
| 2011/0037664 | A1* | 2/2011 | Cho et al. | 343/702 |
| 2011/0187608 | A1* | 8/2011 | Byun et al. | 343/702 |
| 2011/0207404 | A1* | 8/2011 | Shimasaki | 455/41.2 |
| 2012/0038540 | A1* | 2/2012 | Jacob et al. | 343/878 |

* cited by examiner

*Primary Examiner* — Dameon E Levi
*Assistant Examiner* — Collin Dawkins
(74) *Attorney, Agent, or Firm* — Watson Rounds; Marc D. Foodman

(57) ABSTRACT

A device, apparatus and method for producing a body or platform interfaced with a wideband antenna system. The antenna interfaces to the body or platform so as to comprise a synergistic radiating system.

23 Claims, 6 Drawing Sheets

153.8 MHz Standard Whip versus a UHF Antenna with Interfacing Medium

136 MHz Standard Whip versus a UHF Antenna with Interfacing Medium

174 MHz Standard Whip versus a UHF Antenna with Interfacing Medium

222 MHz Standard Whip versus a UHF Antenna with Interfacing Medium

450 MHz Standard Whip versus a UHF Antenna with Interfacing Medium

DEVICE, APPARATUS AND METHOD FOR PRODUCING A BODY OR PLATFORM INTERFACED WITH A WIDEBAND ANTENNA SYSTEM

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

The subject matter presented herein relates generally to radio and wireless communication systems. To those skilled in the art it is well understood that the radiated signal pattern is adversely affected by ground plane imperfections, near field objects and the resultant ground currents due to overall platform composition. In reality and function, if an antenna is mounted on a platform such as a vehicle the antenna must be installed with sufficient height above the platform in order to overcome these effects. Similar adverse conditions exist with cellular and mobile phones. Signal coverage is affected by the user. RF radiation is absorbed into the body, specifically the head and arm of the user. This absorption affects the overall signal pattern due to azimuthal attenuation. Additionally, conventional or standard antenna are in close proximity to the user's head. The conventional antenna commonly used will interface to the head to some degree and the jaw, ear, eye, and brain will be subjected to electromagnetic radiation when the cellular phone or radio is transmitting. The conventional antenna configuration is thus considered a point source radiator, and therefore the energy emitted is from a concentrated source. The need exists for an antenna system that is constructed in a manner in which signal radiation is not absorbed by the platform or user and the azimuthal attenuation is reduced thus increasing signal coverage. Such a device and antenna system is the subject matter of the present invention.

BRIEF DESCRIPTION OF THE DRAWINGS

For a better understanding of the present invention, and to show more clearly how it functions, reference will now be made, by way of example, to the accompanying drawings. The drawings show embodiments of the present invention in which.

Figure 1A:
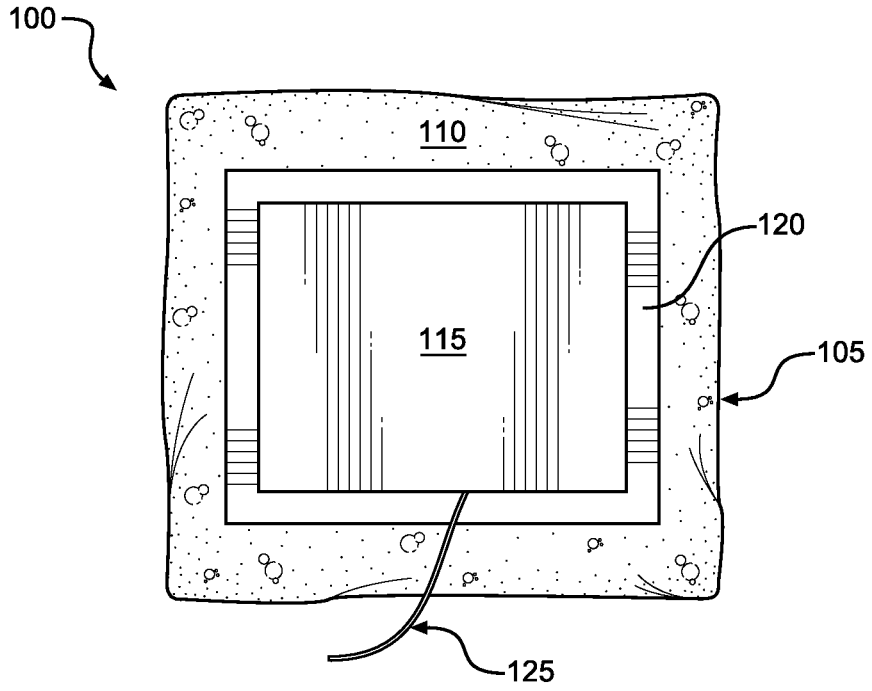
FIG. 1A is a top view.

DETAILED DESCRIPTION OF THE INVENTION:

The present invention will now be described more fully with reference to the accompanying drawings. It should be understood that the invention may be embodied in many different forms and should not be construed as limited to the embodiments set forth herein. Throughout FIGS. 1-8, like elements of the invention are referred to by the same reference numerals for consistency purposes.

The present invention is a device, apparatus and method that has been developed to allow the antenna to interface to the body or platform so as to comprise a synergistic radiating system. This is analogous to systems using "ultrasound techniques." The ultrasonic signal does not interface well to the body without a specialized interfacing medium. In the ultrasound case this medium is a gel that is applied to the area to be scanned. The gel is of the type known as a cross-linked polymer (acrylamide) and serves as an acoustic coupling medium. Use of a gel of this type is applied between the ultrasound wand and the patient's body to keeping discontinuities to a minimum and allowing maximum signal transference. While ultrasound is completely different from cellular technologies, the use of a gel in a cellular antenna application may be considered analogous given the need to provide a medium between the antenna and the body that allows for a conformal interface to exist therefore minimizing any potential discontinuities. In this case the antenna is flexible in nature and the medium used for the interface is also pliable so as to allow for a conforming interface.

Figure 1B:
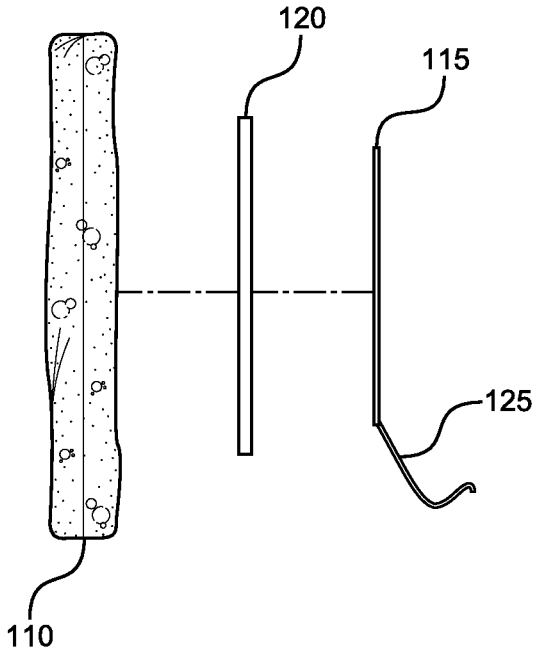
FIG. 1B is a side view and FIG. 1C is a perspective view of an antenna system of the present invention.
Figure 1C:
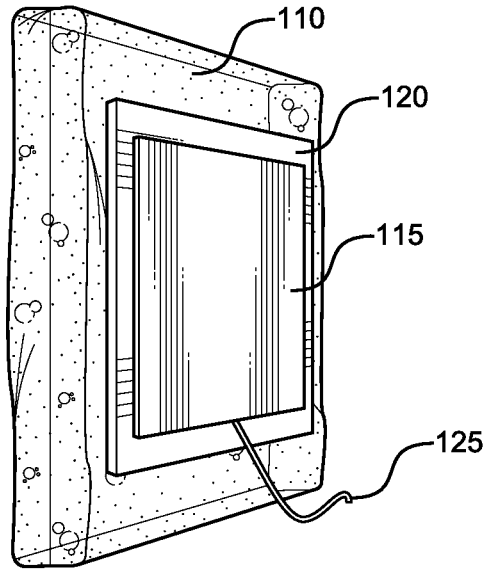

The apparatus for interfacing a body or platform with a wideband antenna system 100 (also referred to as a "radiator") is shown in FIGS. 1A-1C where FIG. 1A is a top down view, FIG. 1B is a side view, and FIG. 1C is a perspective view. Wideband antennas typically operate in the frequency range of approximately 20 MHz up to approximately 2.8 GHz and over a pitch range that is approximately 6 octaves. A platform may be a person using a cellular phone, a vehicle to which a cellular phone connects, or any other mass to which an antenna is capacitively/inductively coupled through contact. For a wearable device, the platform comes into contact with antenna system 100 through conformal interfacing medium 105 comprised of a bladder 110 proportionately sized to the dimensions of an antenna 115 with bladder 110 overlapping the dimensions of antenna 115 to minimize edge effects . . . Between bladder 110 and antenna 115 is an interface 120 onto which antenna 115 is overlaid. Bladder 110, interface 120 and antenna 115 form antenna system 100, which is a meta-substrate formed from the three layers—bladder 110 on one side, antenna 115 on the other side and interface 120 sandwiched in-between.

As can be seen from FIGS. 1A-1C, interface 120 which may be formed of plastic, or another dielectric, extends beyond antenna 115 on all sides, and likewise, bladder 110 extends beyond interface 120 on all sides . . . The preferred overlap of bladder 110 beyond antenna 115 is in the range of ⅛"-⅜". Antenna 115 is a planar antenna, meaning that it is typically formed of a flat sheet of copper or other conductive metal. A planar antenna emits radiation from around the edges in sharp contrast to a dipole antenna which emits radiation from the tip as in a whip antenna, making it a point source radiator. The overlap of bladder 110 and plastic interface 120 smooths radiation emission from antenna 115 in a predominantly radial direction allowing a more uniform propagation.

Bladder 110 and interface 120 are preferably formed of a plastic or dielectric material such as Delrin or another polyoxymethylene. This type of plastic has a crystalline structure and works effectively to dissipate electro-static charge. It also has a very high dielectric breakdown potential of approximately 22 killivolts or 22,000 volts. A coaxial cable 125 extends from antenna 115 for connection to a device such as a cellular phone or other device to which antenna 115 is attached which may be, for example routers, two-way radios, wfii networks, or any other wireless device that transmits and/or receives an RF signal. For most antenna systems, including antenna system 100 of FIGS. 1-2, the outer shielding on coaxial cable 125 is attached or grounded to an antenna ground plane. However, in the case of an alternative embodiment of antenna 115, such as that shown in FIGS. 3A-3C, the ground is unterminated allowing it to float thereby aiding the coupling effect to a platform or user.

bladder 110 in an embodiment for a body-worn antenna system 100 like that shown in FIGS. 1A-1C, will have approximate dimensions of 8 mm thick by 10 mm in height by 11 mm in width on which antenna 115 is laid having approximate dimensions of 2 mm thick, by 8 mm in height by 9 mm in width. For a bladder 110 of this size, it will be filled with a mixture consisting of approximately 150 ml of $H_2O$, a polar substance. However, the amount of water and fluid mixture is contingent and proportional to the size of antenna 115. A solution of at least 40%, by volume, of NaCl and/or KCl or a salt with low solubility product is dissolved in the water. This dissolved mixture is heated to approximately 180 degrees Fahrenheit. Then a binder material consisting of a $C_6H_{10}O_5$ is blended into the solution and serves as a thickening agent. It should be noted that a variety of other powdered or granulated materials such as $Al_2O_3$ or a variety of desiccant materials and/or thickening agents both organic and inorganic can be used. The purpose of the thickening agent is to improve the homogeneity of the mixture to cause sufficient distribution of the cat-ions contained in the mixture. When the radiating element emits radio frequency (RF) transmissions into the medium the cat-ions in the solution will act as re-radiators which enhance the interface between the platform and antenna 115. Although the body worn antenna system 100 of FIGS. 1A-1C has been described with approximate dimensions, it should be understood that the antenna system will require a different configuration with different dimensions for other applications where the principles of operation of the antenna are still the same as those described with respect to FIGS. 1A-1C.

Figure 2:
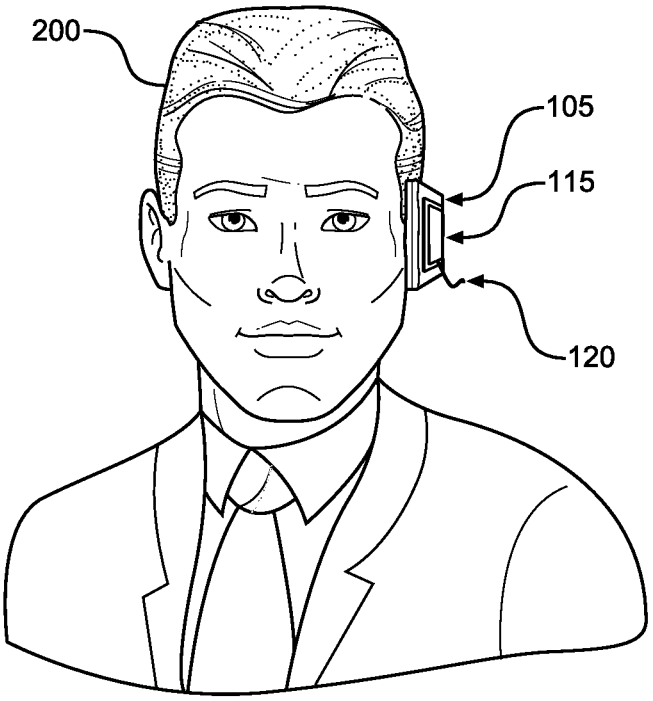
FIG. 2 is a view of an antenna system with a platform.

FIG. 2 is a side view of an antenna system 100 shown in use against the side or surface of a host platform 200. For example, host platform 200 may be the head of a person and may extend to other portions of the person's body such as an arm, neck, torso or leg. The coupling causes platform 200 (e.g. the user, a vehicle or other platform) to become part of the radiating system thereby greatly increasing the effectiveness of antenna 115.

Figure 3C:
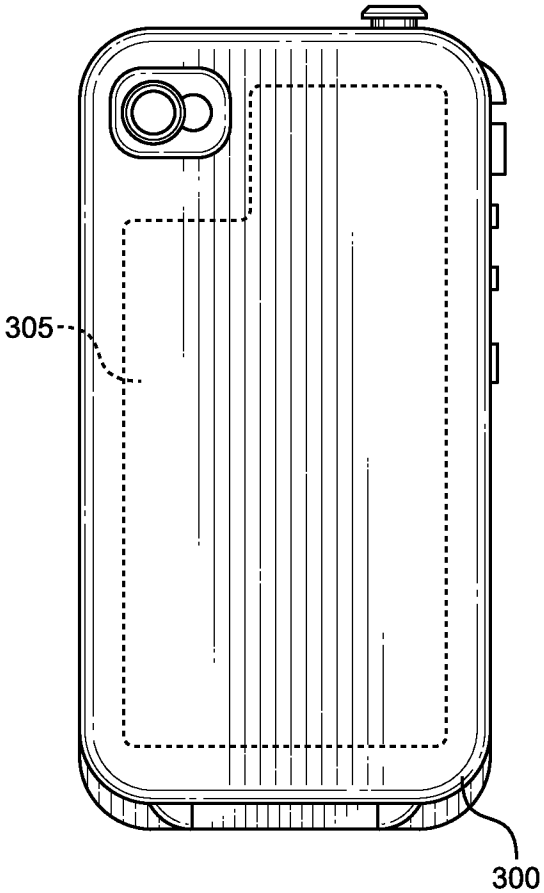
FIGS. 3A-3C are views of an embodiment of an antenna system in a case for a cellular phone.
Figure 3B:
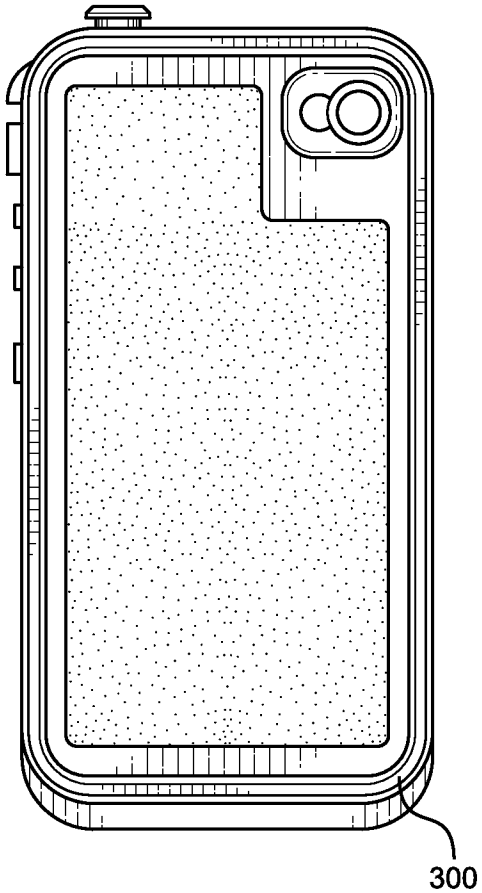
Figure 3A:
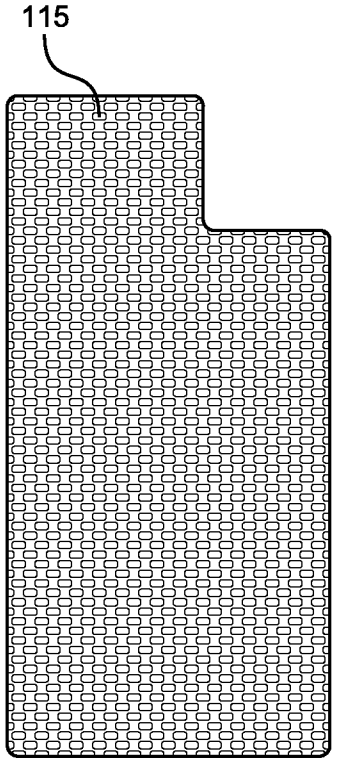

FIGS. 3A-3C are views of an embodiment of an antenna system 100 provided in a case 300 for a cellular phone. FIG. 3A shows antenna 115 which is formed of wire mesh, copper or other conductive material. It is essentially flat and cut to the shape of the cellular phone. FIGS. 3B and 3C show a case 300 for an iPhone 4S. Antenna 115 is laid over and affixed to the inside back surface 305 of case 300 as shown in FIG. 3B. Case 300 is typically a plastic or rubber material that is a dielectric. In this configuration, when a cellular phone is placed in case 300, the back of the phone makes a capacitive/inductive coupling between three-layer substrate antenna system 100 and the one or more antennas that are built into the cell phone itself for handling different functions such as cellular phone service using different formats for voice, data, texting etc. (e.g. edge, code division multiple access—"CDMA," global system for mobile—"GSM," time division multiple access—"TDMA," etc.). FIG. 3C shows the back of case 300 with antenna 115 affixed inside case 300 and with a cut-out to show the position of antenna 115 inside case 300. With the embodiment of FIGS. 3A-3C, the ground is unterminated allowing it to float thereby aiding the coupling effect to a platform or user.

Figure 4:
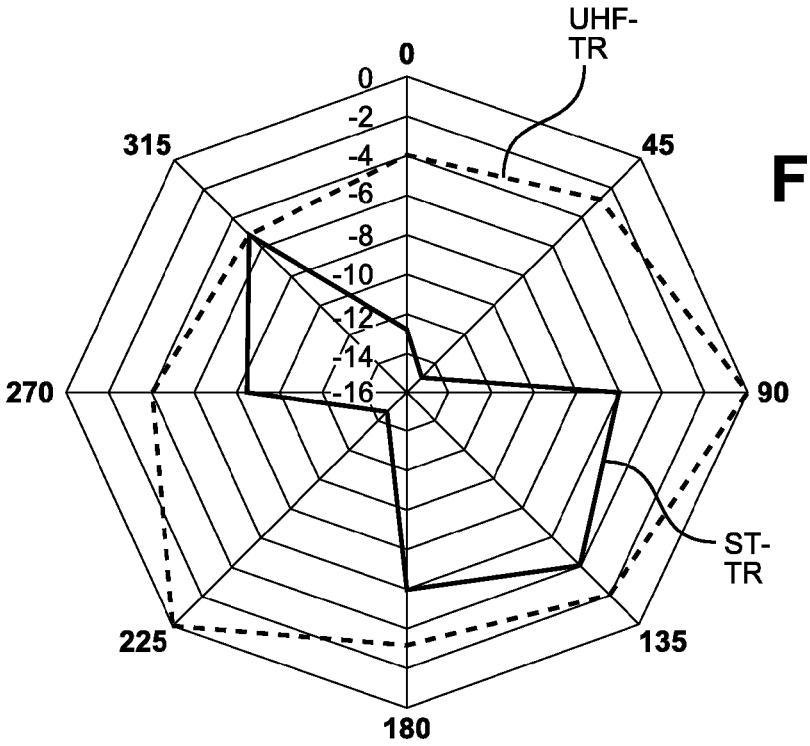
FIG. 4 shows a plot of a 153.8 Mhz standard whip trace versus the trace for an antenna with an interfacing medium of the present invention.

The positive effects achieved with the use of antenna system 100 are depicted in the graph shown in FIG. 4 where a 153.8 Mhz signal for a standard whip antenna trace ST-TR is compared to a corresponding trace UHF-TR using an antenna with interfacing medium 105 of the present invention, also referred to as a "UHF antenna." The traces are measured in decibels on a scale from 0 to −16 dB in FIG. 4. In addition to minimizing the discontinuities that may exist between interfacing medium 105 and host platform 200, the antenna design is such that the energy is spread over a larger surface area than would be true for a point source radiator. This allows for the same amount of power to be transmitted by the resultant volts/centimeter$^2$ so that exposure to the user is minimized as well.

FIG. 4 represents a measurement made at 153.8 MHz with a standard radio having a standard OEM whip antenna with the radio attached to the left side of the user's trouser belt. The azimuthal scale from 0-360 degrees is shown for a user where zero (0) degrees represents the orientation at the front of the face in the area generally around the nose of the user. The scale rotates around the user with 45 degrees at the side of the face, 90 degrees at the right ear, 135 degrees between the right ear and the back of the head, 180 degrees at the back of the head, 225 degrees between the back of the head and the left ear, 270 degrees at the left ear, and 315 degrees at the left side of the face.

As can be seen there is a signal maximum for the standard case at 315 degrees which is to the left of the user's centerline. There is also a maximum at 135 degrees with spread points between 90 degrees and 180 degrees between the right ear and the back of the head. It should be noted that the whip antenna interfaces to the body at what is equivalent to a point source and the radiated energy is about 3 dB below the peak of the front side maximum. The integral of the radiated energy is less than that of antenna trace UHF-TR for antenna system 100. This energy differential is either reflected back to the radio or is absorbed by the body. In either case this represents a decrease in sensitivity on receive as well as a loss in path length available to the desired receiver both in distance as well as azimuthal coverage.

UHF antenna system 100 is mounted on the user's back side and below the shoulder blades, a placement that is turned approximately 180 degrees relative to the standard whip antenna. It can be seen that the radiated energy is spread more evenly in azimuth than the standard whip antenna. Therefore, more energy is distributed over the body and re-radiated rather than absorbed by the body or reflected back to the radio or cellular device.

It is known that the radiation pattern of a conventional wideband antenna varies as a function of frequency since the antenna ground currents and near field effects vary as a function of frequency.

Figure 5:
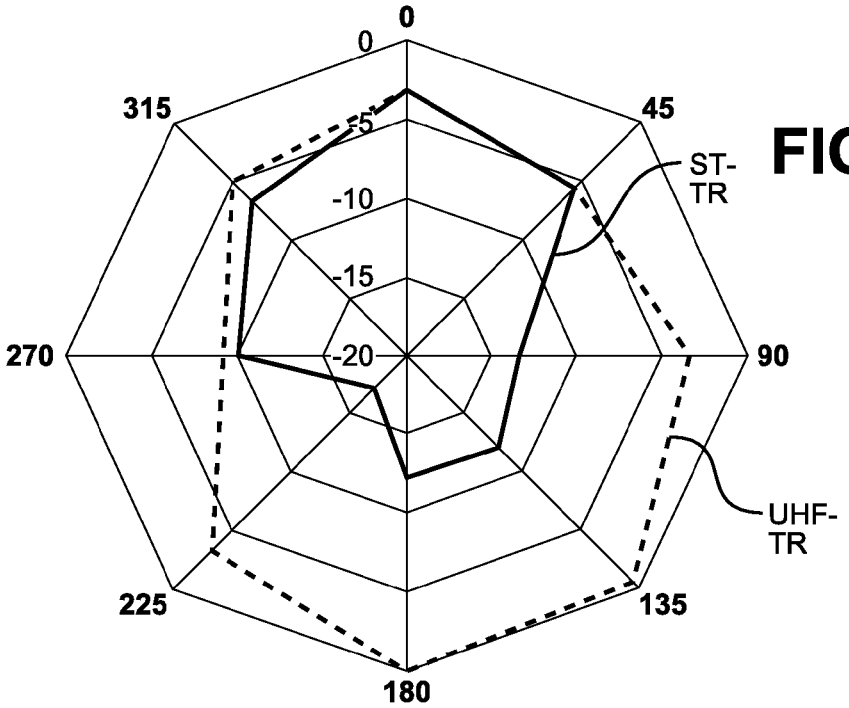
FIG. 5 shows a plot of a 136 Mhz standard whip trace versus the trace for an antenna with an interfacing medium of the present invention.
Figure 6:
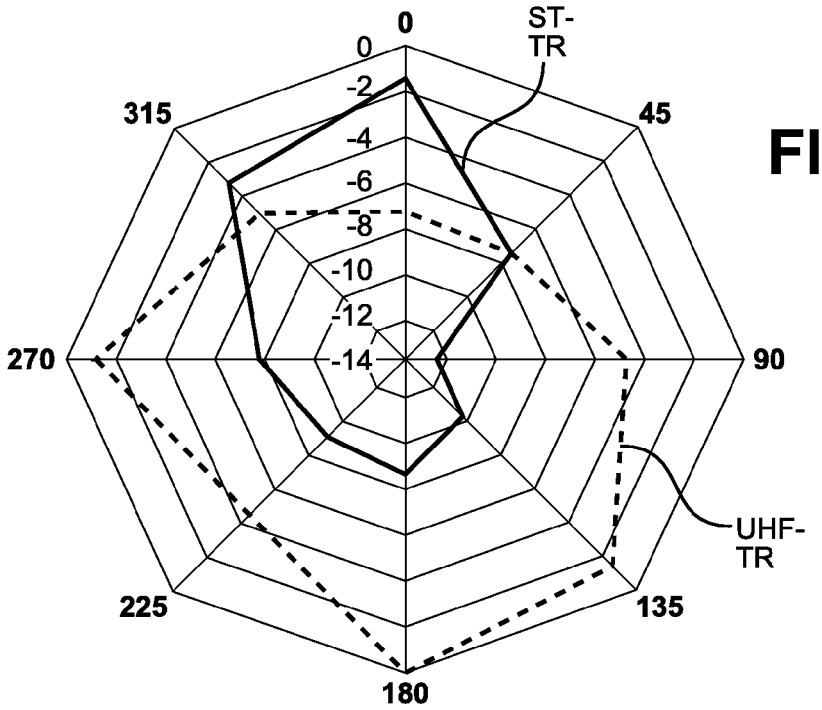
FIG. 6 shows a plot of a 174 Mhz standard whip trace versus the trace for an antenna with an interfacing medium of the present invention.
Figure 7:
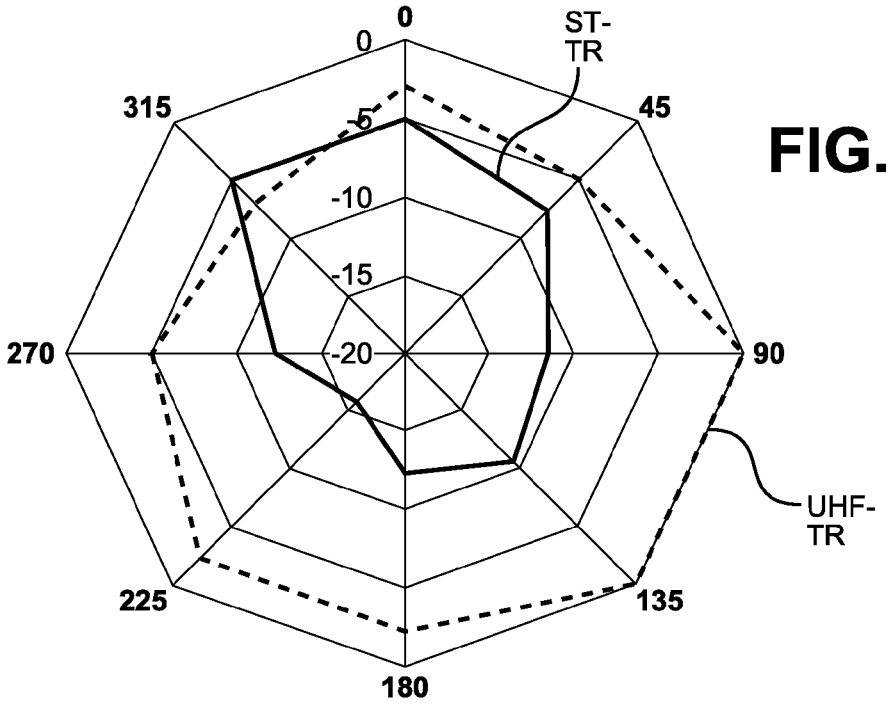
FIG. 7 shows a plot of a 222 Mhz standard whip trace versus the trace for an antenna with an interfacing medium of the present invention.
Figure 8:
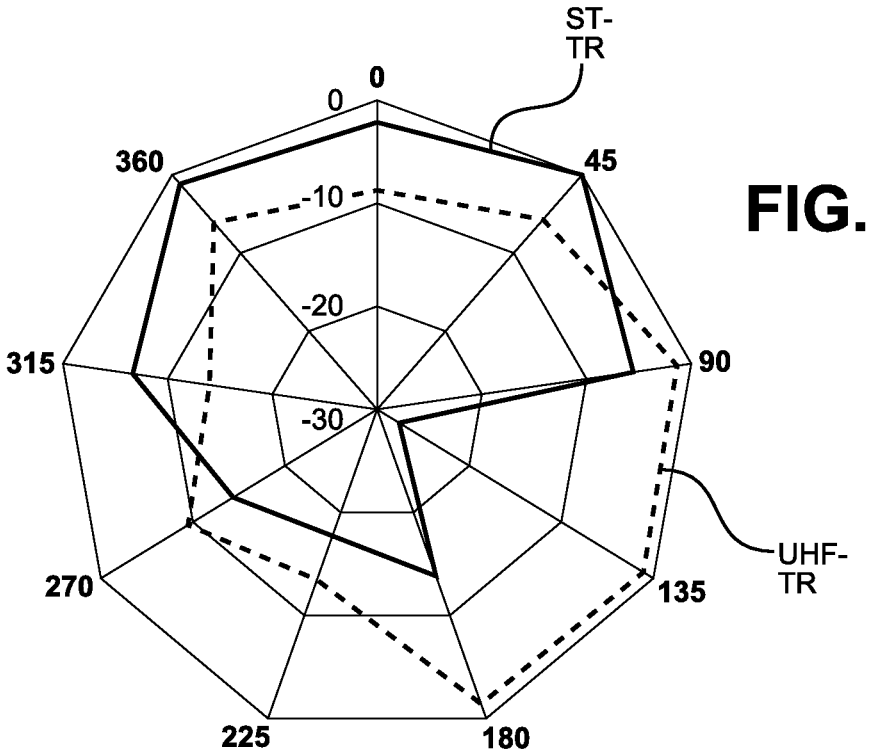
FIG. 8 shows a plot of a 450 Mhz standard whip trace versus the trace for an antenna with an interfacing medium of the present invention.

FIGS. 5-8 show examples of various frequency responses for the traces of the standard whip versus UHF antenna system 100. In each case, the standard whip antenna patterns vary greatly as a function of frequency while UHF antenna system 100 of the present invention does not vary as greatly as a function of frequency. In all cases the mounting of both antennas is constant while the resulting trace covers a larger area. FIG. 5 shows the respective traces at 136 Mhz where standard whip trace ST-TR is shown as a solid line and UHF antenna trace UHF-TR is shown as a dotted line. Similarly, FIG. 6 shows the respective traces at 174 Mhz where standard whip trace ST-TR is shown as a solid line and UHF antenna trace UHF-TR is shown as a dotted line. FIG. 7 shows the respective traces at 222 Mhz where standard whip trace ST-TR is shown as a solid line and UHF antenna trace UHF-TR is shown as a dotted line. FIG. 8 shows the respective traces at 450 Mhz where standard whip trace ST-TR is shown as a solid line and UHF antenna trace UHF-TR is shown as a dotted line.

As can be seen from the figures, the present antenna solution with the interfacing medium affords the user far more uniform coverage in the azimuthal direction as well as the superior gain for most directions. This uniformity in coverage is very important for cases where wideband frequency agile communication systems are used.

The UHF antenna is just a representation of the concept used in one embodiment of the invention. What makes this antenna system unique and novel is the combination of platform 200, conformal interface 105 and the fact that coaxial cable 125 coming from the radio or transceiver to the antenna has its shield un-terminated thus allowing the emitted signal radiation to be more evenly distributed over the body or platform and to be re-radiated away from the body or platform. Only the center conductor interfaces directly to the antenna structure. In this example the antenna is a thin flexible sheet of ABS plastic with a copper antenna structure. In another preferred embodiment, a fine stainless steel mesh is used which improves flexibility and avoids the work hardening effect that copper structures are subject to. The shield acts as the lower part of antenna 100 and this is interfaced to user platform 200. Other antenna structures are proposed based on the present invention which may require that interfacing medium 105 be optimized for desired performance primarily by controlling the thickness of the dielectric material to match the impedance between planar antenna 115 and the interface dielectric. For a voltage standing wave ratio ("VSWR") above 300 Mhz, it is preferred to have a VSWR of two to one While the invention has been described with respect to the figures, it will be appreciated that many modifications and changes may be made by those skilled in the art without departing from the spirit of the invention. For example, antenna 115 may be cut to any size to fit a case or to be positioned within antenna system 100 provided there is capacitive/inductive coupling between antenna 115 and the platform. Any variation and derivation from the above description and drawings are included in the scope of the present invention as defined by the claims.

What is claimed is:

1. A system for coupling a distributed return antenna to a platform comprising:

a planar antenna formed of conductive material having:

an edge; and a coaxial cable with an unterminated shield and a center conductor that is connected to the edge for alternatively receiving and transmitting signals through the airwaves, wherein the center conductor is not connected to the unterminated shield;

a bladder containing an ionic medium;

an interface positioned between the antenna and the bladder; and wherein the planar antenna is capacitively coupled to the platform through the interface and the ionic medium with a distributed ground return coupled between the platform and the unterminated shield.

2. The system of claim 1 wherein the planar antenna system emits radiation from the boundary that is formed around an exterior perimeter of the planar antenna system to provide predominantly evenly distributed RF radiation in a radial pattern over the platform.

3. The system of claim 1, wherein the shield is unterminated and the coaxial cable has a floating ground at an antenna end.

4. The system of claim 1 wherein the ionic interface is a material disposed in the bladder that has a dielectric constant with dielectric properties sufficient to couple RF energy to the platform resulting in radiation being radiated away from the platform.

5. The system of claim 4 wherein the bladder comprises polyoxymethylene.

6. The system of claim 1 wherein the center conductor of the coaxial cable interfaces directly to the planar antenna at a point along the edge.

7. The system of claim 1, wherein radiation is emitted from the edge of the planar antenna system in an azimuthal pattern that is predominantly symmetrical over the frequency range.

8. The system of claim 1 wherein the planar antenna is formed of flexible material of a type from one of the group comprising: (a) copper; (b) wire mesh; (c) or another thin pliable conductive material.

9. The system of claim 4 wherein the dielectric constant is in an approximate range of 3.8-4.5.

10. The system of claim 1 wherein the platform is at least one of the type comprising: (a) a vehicle; or (b) one or more portions of the body of a user; or, (c) any other mass that the planar antenna is physically coupled to.

11. The system of claim 1 wherein the bladder is proportionately sized to the dimensions of the planar antenna with an overlap slightly larger than the planar antenna and in the range of ⅛"-⅜".

12. The system of claim 1 wherein the planar antenna is a wideband antenna.

13. A method of coupling a distributed return antenna to a platform comprising:

forming a planar antenna of conductive material having an edge and a coaxial cable with an unterminated shield and center conductor connected to the edge for alternatively receiving and transmitting signals through the airwaves, wherein the center conductor is not connected to the shield;

providing a bladder containing an ionic medium;

positioning an interface between the antenna and the bladder; and capacitively coupling the planar antenna to the platform through the interface and the ionic medium with a distributed ground return coupled between the platform and the unterminated shield.

14. The method of claim 13 wherein the planar antenna system emits radiation from the edge that is formed around an exterior perimeter of the planar antenna system to provide predominantly evenly distributed RF radiation in a radial pattern over the platform.

15. The method of claim 13 wherein the shield is unterminated and the coaxial cable has a floating ground at an antenna end of the coaxial cable.

16. The method of claim 13 wherein the ionic material is disposed in a bladder having a dielectric constant with dielectric properties sufficient to RF energy transfer to the platform.

17. The method of claim 16 wherein the bladder comprises polyoxymethylene.

18. The method of claim 13 wherein the center conductor of the coaxial cable interfaces directly to the planar antenna at a point along the edge.

19. The method of claim 13 wherein radiation is emitted from the edge of the planar antenna system in an azimuthal pattern that is predominantly symmetrical over the frequency range.

20. The method of claim 13 wherein the planar antenna is formed of flexible material of a type from one of the group comprising:

(a) copper; (b) wire mesh; (c) or another thin pliable conductive material.

21. The method of claim 16 wherein the dielectric constant is in an approximate range of 3.8-4.5.

22. The method of claim 13 wherein the platform is at least one of the type comprising: (a) a vehicle; or (b) one or more portions of the body of a user; or, (c) any other mass that the planar antenna is physically coupled to.

23. The method of claim 13 wherein the planar antenna is a wideband antenna.

* * * * *